US011324306B2

(12) United States Patent
Joye

(10) Patent No.: US 11,324,306 B2
(45) Date of Patent: May 10, 2022

(54) PAINT CAN HOLSTER

(71) Applicant: Darrell Andrew Joye, Pawley's Island, SC (US)

(72) Inventor: Darrell Andrew Joye, Pawley's Island, SC (US)

( * ) Notice: Subject to any disclaimer, the term of this patent is extended or adjusted under 35 U.S.C. 154(b) by 0 days.

(21) Appl. No.: 17/210,140

(22) Filed: Mar. 23, 2021

(65) Prior Publication Data

US 2021/0298462 A1 Sep. 30, 2021

Related U.S. Application Data

(60) Provisional application No. 63/001,584, filed on Mar. 30, 2020.

(51) Int. Cl.

| | |
|---|---|
| ***A45F 5/02*** | (2006.01) |
| ***B44D 3/14*** | (2006.01) |
| *A45F 5/00* | (2006.01) |

(52) U.S. Cl.

CPC ..... *A45F 5/021* (2013.01); *B44D 3/14* (2013.01); *A45F 2005/002* (2013.01); *A45F 2005/006* (2013.01)

(58) Field of Classification Search

CPC ..... A45F 5/021; A45F 2005/002; A45F 2005/006; B44D 3/14

USPC ..... 224/148.4, 904, 625, 200, 247

See application file for complete search history.

(56) References Cited

U.S. PATENT DOCUMENTS

| | | | | | |
|---|---|---|---|---|---|
| 2,463,651 | A * | 3/1949 | Stevens | A47G 23/0241 | 215/395 |
| 2,985,349 | A | 5/1961 | McGuire | | |
| 3,915,361 | A * | 10/1975 | Perkins | F41C 33/045 | 224/666 |
| 3,997,092 | A | 12/1976 | Pogwizd | | |
| 4,325,503 | A * | 4/1982 | Swinney | A45F 5/02 | 224/148.4 |
| 4,607,772 | A * | 8/1986 | Hancock | B62J 7/06 | 224/413 |
| D286,949 | S * | 12/1986 | Hardman | 224/197 | |
| 4,746,042 | A * | 5/1988 | King | A45F 5/02 | 224/148.2 |
| D313,169 | S * | 12/1990 | Scott | D8/373 | |
| 5,013,074 | A * | 5/1991 | Galle | A47G 23/0241 | 215/395 |
| 5,035,523 | A * | 7/1991 | Allinder | A47K 7/03 | 224/663 |
| 5,170,918 | A * | 12/1992 | Perron | A41F 9/002 | 224/663 |
| 5,464,137 | A * | 11/1995 | Shirdavani | A41F 9/002 | 2/45 |

(Continued)

*Primary Examiner* — Adam J Waggenspack

(74) *Attorney, Agent, or Firm* — R. K Merting, LLC; Robert K. Merting

(57) ABSTRACT

The present invention comprises a Paint Can Holster that securely holds a standard one-gallon paint can at the waist of the user. The paint can may be placed into the holster from the horizontal direction allowing the user to easily holster and unholster paint cans while wearing the invention. The holster further features a paintbrush holder that positions the bristles of the brush directly over or into the paint can to avoid dripping paint. The paint can holster further features a swiveling mechanism that allows the user to ascend and descend a ladder and to make a wide range of motions without tilting the paint can over and spilling paint.

12 Claims, 10 Drawing Sheets

(56) References Cited

U.S. PATENT DOCUMENTS

| | | | | | |
|---|---|---|---|---|---|
| 5,490,618 | A * | 2/1996 | Davidson | B44D 3/14 | 224/148.4 |
| 5,497,921 | A * | 3/1996 | Dancyger | A45F 5/021 | 224/148.6 |
| D370,559 | S * | 6/1996 | Arndt | D3/229 | |
| 5,893,503 | A * | 4/1999 | Jean | A45F 3/14 | 224/626 |
| 5,927,574 | A * | 7/1999 | Ruesink | F41C 33/003 | 224/149 |
| 6,045,017 | A * | 4/2000 | Connell | A45F 5/02 | 224/148.4 |
| 6,283,345 | B1 * | 9/2001 | Butschat | A45F 5/02 | 224/148.4 |
| 6,390,348 | B1 * | 5/2002 | Godshaw | A45F 5/00 | 224/660 |
| 6,557,738 | B1 * | 5/2003 | Meintzer | A45F 5/00 | 224/148.7 |
| 6,769,586 | B1 * | 8/2004 | Beletsky | A45F 5/02 | 224/678 |
| 6,866,172 | B2 | 3/2005 | Shackelford | | |
| 9,210,992 | B2 * | 12/2015 | deBeers | A45F 5/02 | |
| 9,538,834 | B2 * | 1/2017 | Dietmeyer | A45F 5/02 | |
| 2006/0065668 | A1 * | 3/2006 | Whitaker | B44D 3/123 | 220/737 |
| 2008/0054030 | A1 * | 3/2008 | Diaz | B44D 3/14 | 224/148.7 |
| 2019/0160860 | A1 | 5/2019 | Danny et al. | | |

* cited by examiner

PAINT CAN HOLSTER

CROSS REFERENCE TO RELATED APPLICATIONS

This application claims the benefit of U.S. provisional patent application Ser. No. 63/001,584 filed Mar. 30, 2020

FIELD OF THE INVENTION

The present invention relates to a wearable paint can carrier designed for easy holstering and un-holstering of a standard paint can. The invention additionally provides for a swivel means of keeping the paint can oriented such that the top of the paint can remains vertically upward as the wearer moves. In a preferred embodiment of the invention, there is a means for suspending a paintbrush above or within an open paint can and thereby catching any dripping paint in the open paint can.

RELATED ART

Paint is standardly sold in one-gallon cans, and for decades painters and construction works have devised means to carry paint on the job site. Wearable paint pails were designed for ergonomic fit to the side of a human body. U.S. Pat. No. 6,866,172 is a good example of a non-cylindrical paint pail designed to fit adjacent to the human waist.

Inventions in the vein of U.S. Pat. No. '172 however fall short in many respects. First, proprietary containers require either a wholesale change in the market of paint cans to the proprietary shaped container, or it requires the user to move paint from the can in which purchased to the proprietary container.

Because proprietary container pails have not become popular in the market, users must transfer paint from the container in which it was purchased to the proprietary container. The transfer of paint presents an opportunity for spillage and requires a thorough cleaning of the proprietary container between every change in paint color or type. The additional labor necessary to constantly clean a proprietary paint container and the inherent loss in paint inhibits the popular adoption of solutions such as U.S. Pat. No. '172.

Another common deficiency with existing art is exhibited in U.S. Pat No. '172. The paint container described has no mechanism for self-righting as the user moves. That is, if the user bends over, ascends or descends a ladder at an angle, or performs any other activity that causes the body to be oriented in a direction other than vertical, the paint container will tilt and the paint is prone to coming out of the container and splattering onto the user and other surfaces.

These deficiencies were addressed in U.S. Pat. No. 5,490,618. U.S. Pat. No. '618 teaches both a holster designed to hold a standard paint can and a means of keeping the paint can upright during ascending and descending a ladder. U.S. Pat. No. '618 however exemplifies another problem in the existing art of holders designed to accept a standard paint can. Existing paint can holders are designed to vertically accept a paint can lowered into the holder from the top. This action requires a strict range of motion along the side of the user. As seen in U.S. Pat. No. '618, a long flat panel is part of the holder, and said flat panel provides a guiding surface to raise and lower the paint can.

By necessity, this panel starts at the belt line and continues lower to the knee. If the panel were raised, the flat surface would be up to the chest of the user, and this would limit use to only those persons with a relatively flat stomach in line with their waste. As the majority of Americans carry some extra weight, and most users have a rotund stomach, it is impractical to raise this panel above the belt line The necessity of being able to place the paint can both adjacent to the human body and directly above and vertically in line with the paint can holder requires lowering the paint can holder to the lower thigh or knee of the user. In this location, the weight of the paint and paint can holder is placed below and outward from the center of gravity for the body and causes the person to be off-balance. This is less than ideal when a user is ascending and descending ladders and working from dangerous heights.

Some existing art attempts to overcome the above issues by relying upon a paint can's integral handle for attachment. One example is Patent Application US 2019/0160860 A1. Such configuration however relies upon the integral paint can handle meeting the same specifications as the holder. Variances from manufacturer to manufacturer are difficult to impossible to accommodate in one embodiment. Additionally, such means of securing the paint can are limited in durability and control to the handle quality originally included with the paint can.

Another deficiency of the existing art is the lack of a useable paintbrush holder integrated into the paint can holder. U.S. Pat. No. 3,997,092 exemplifies the existing art regarding paintbrush holders. Paintbrushes are held outside of the paint can. Such a location is fine for a dry, unused brush. However, these holders create a mess if used with a brush covered in wet paint. To avoid the mess, the user may leave the brush loose in the can, but this can lead to covering a small brush entirely in paint and soaking a brush with more paint than necessary.

Another deficiency of the existing art for holding a standard paint can is the ergonomic fit to the human body. Prior art, such as U.S. Pat. No. '092, creates an ergonomic structure that is also large enough to hold a paint can. This however leaves the user with a much larger structure attached to their side that includes bulk comprising unused space. If a paint can is directly attached to the human body, as shown in U.S. Pat. No. '618, a flat panel lays adjacent to the body and is only suitable for those persons who themselves are relatively flat. No padding is provided to account for the natural variations of the human body.

Therefore a need exists for a paint can holder that can accept a standard paint can, that swivels to maintain the can in a vertical orientation, does not require a long vertical plane to holster the can, holds a brush in a manner to eliminate dripping and mess from wet bristles, and mounts to the body ergonomically.

BRIEF SUMMARY OF THE INVENTION

In one embodiment of the present invention a wearable paint can holster is designed to accept a standard, one-gallon sized, paint can along the horizontal axis. The holster consists of i) a two sided flat panel oriented vertically with a top end and a bottom end and with one side facing-the-user and the other side opposite-the-user, ii) two arms, immediately opposite each other, protruding roughly perpendicularly, from the side of the flat panel opposite-the-user, iii) a base plate, below the two arms, that protrudes roughly perpendicular from the side of the flat panel opposite-the-user and is oriented with a horizontal side roughly parallel to the ground surface. The holster securely holds the paint can between the two protruding arms and supported by the horizontal base plate. The holster is attached to the user, on or about the waist, by a belt. The invention may also be made in an embodiment where the flat panel and base plate are formed from one piece of material in a roughly L shaped angle bracket.

The arms of the holster are curved and spaced such that insertion of a standard paint can forces the arms to spread outward, and spring tension of the arms securely squeezes the can between the two arms. The horizontal base plate provides support for the weight of the paint can from below and prevents the paint can from vertically sliding out of the holster. The free ends of the two arms may feature padding, a rubber-like grip, or may simply be folded upon themselves to eliminate sharp surfaces. The rubber-like grip, which could be made of any material designed to grip and prevent slippage, adds one more means for retaining the paint can in the holster.

The invention may further include a detachable pad on the side of the flat panel facing-the-user. Said pad can be attached and detached by any number of mechanisms including hook and loop fabric. Said pad may be rectangular in shape, but may also be wedged shape to account for the natural contour of a person's body. In an ideal embodiment, the pad is wedge shape with the narrow end of the wedge facing towards the top end of the flat panel and the wide end of the wedge facing towards the bottom end of the flat panel. Such shape and orientation offsets the natural contour of the human body where the surface of the leg runs inward from the waist. This both pads the holster and straightens the paint can or tilts the opening slightly to the user.

Another embodiment further includes a swivel mechanism attached to the flat panel on the side facing-the-user. This swivel mechanism may be between the pad and the flat panel, or it may replace the pad in its entirety. The swivel is designed such that the holster and the paint can within rotates freely at the user's waist and remains in an upright orientation. To accomplish this, the swivel should be mounted on the flat panel such that the center of gravity for the paint can is below the point of swivel.

The invention can be attached to the user in a number of manners. In the simplest form, a belt is used to attach the holster to the user. The flat panel may feature a belt loop for attaching the belt on either the side of the panel facing-the-user or the side opposite-the-user. In the preferred embodiment, the belt loop is attached to or formed on the side of the flat panel facing-the-user. The belt loop may simply be a flat piece of stiff material, such as metal or plastic, the same width of the flat panel and attached to the flat panel with a spacer in between to provide space for the belt. If the embodiment contains the swivel feature, then the belt loop is incorporated into the swivel in such a manner to allow the holster to swivel freely yet hold the opposite base of the swivel securely against the user. In a preferred embodiment, the belt loop is sized such that the user may move the paint can holster along the belt repositioning it from side to side or to the front of the user with ease.

In a preferred embodiment, an additional shoulder strap is used to supplement the belt in attaching the holster to the user. The shoulder strap attaches to the holster at the upper portion of the flat panel. Said attachment can be by any number of means to include a S-hook, carabiner, shackle, coupling, hook, swivel clasp, or other device on the shoulder strap and a connection point, such as a hole, on the flat panel. The shoulder strap may be augmented with a belt designed to go around the user, under the arm, and connected to the shoulder strap in the front and back of the user. In a preferred embodiment, the shoulder strap is attached such that the user may move the paint can holster freely from side to side while the shoulder strap slides along the connection mechanism providing support in all positions.

In one embodiment of the invention, a paintbrush holder is attached to the flat panel on the side opposite-the-user and immediately above the opening of a holstered paint can. Said paintbrush holder is positioned such that the handle of the brush remains out of the paint, but the bristles of the brush are securely within the paint can. Thereby any drippings from the brush are retained in the paint can. The paintbrush holder can be any sort of holding mechanism that is attached to the flat panel in the appropriate location. Attachment may be by screw, fastener, epoxy, weld, or any other appropriate means.

The present invention is ambidextrous and may be worn on either the left or the right side of the user. The user may freely move the invention from one side to the other to accommodate his preferences or location.

BRIEF DESCRIPTION OF THE DRAWINGS

These and other features and advantages of the present invention will become more readily appreciated as the same becomes better understood by reference to the following detailed description when considered in connection with the accompanying drawings, wherein.

DETAILED DESCRIPTION OF THE INVENTION

Figure 1:
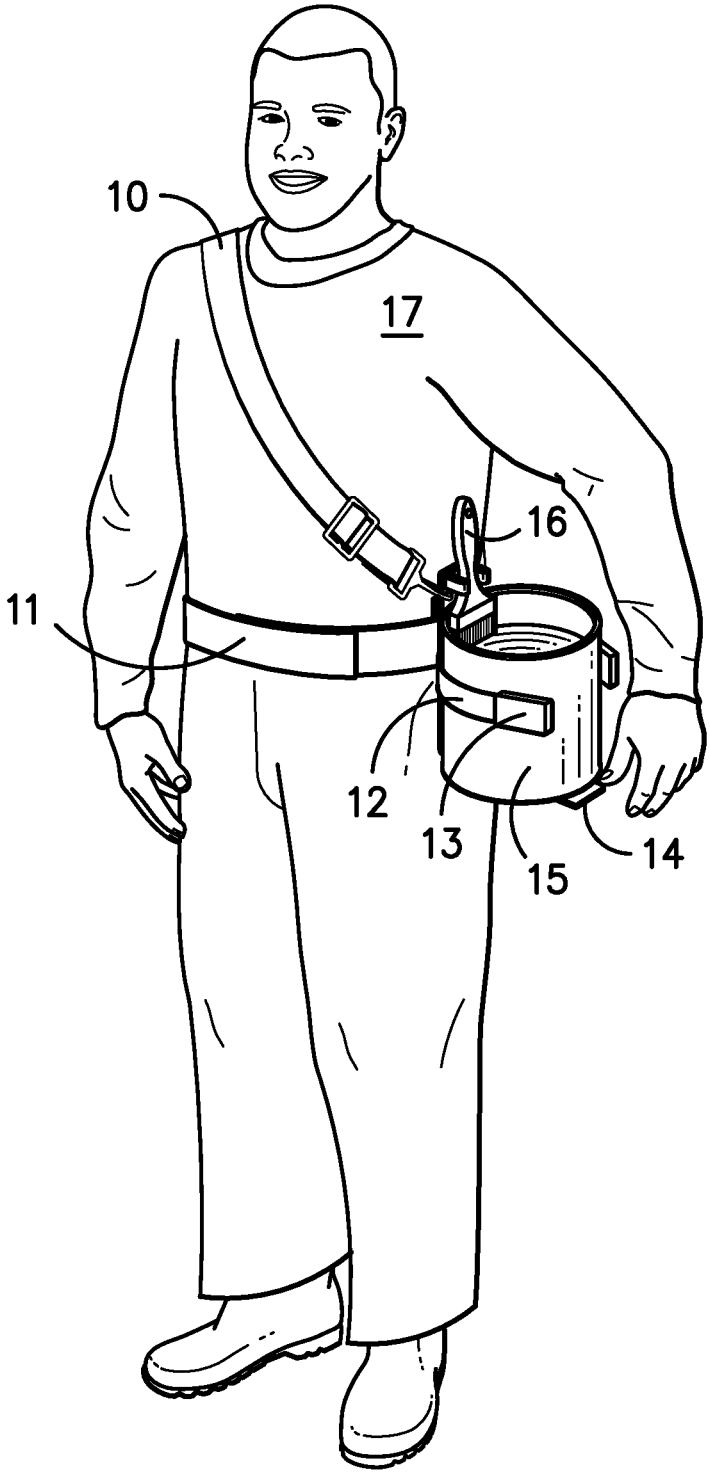
FIG. 1 is a perspective view of one embodiment of the subject invention fully assembled and attached to the user in the standing position.
Figure 2:
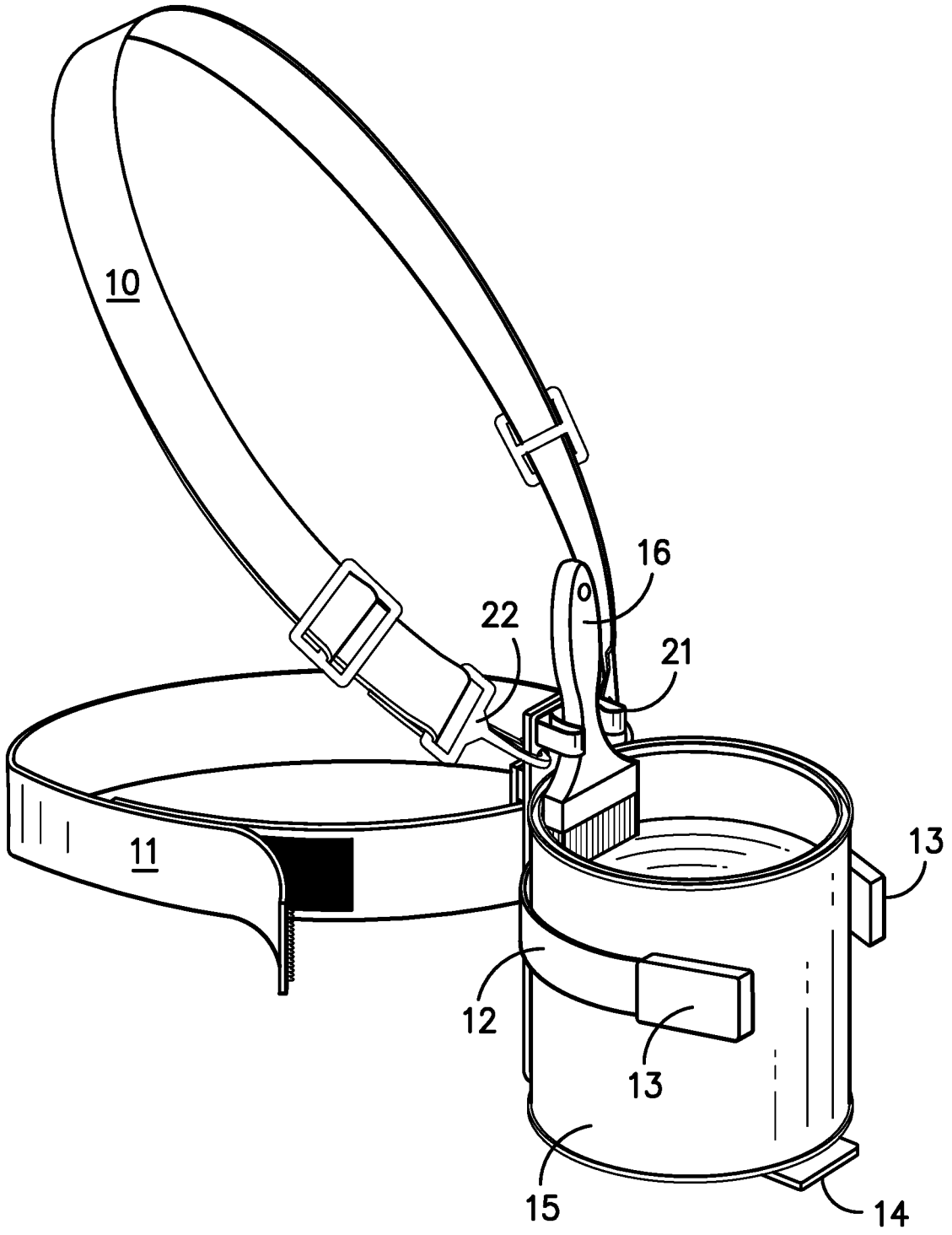
FIG. 2 is a perspective view of one embodiment of the subject invention showing the invention fully assembled and without the user.

Darrell Andrew Joye has invented a Paint Can Holster for the purpose of securing a standard, one-gallon paint can (15) to the waist of the user (17) and holding said can (15) in a vertically upright position during movement by the user (17). The Paint Can Holster can be scaled to accept other sized cylindrical objects. At it's core, the Paint Can Holster consists of a flat panel (42) that features on the outer side two arms (12) and a base plate (14), each protruding out from the flat panel (42) roughly perpendicular from the outer side, used to secure a paint can (15), and on the inner side a mechanism to attach the Paint Can Holster to the user. Said mechanism may be a belt loop (41) or a swivel attachment device (101 to 105) with a belt loop built in.

Figure 10:
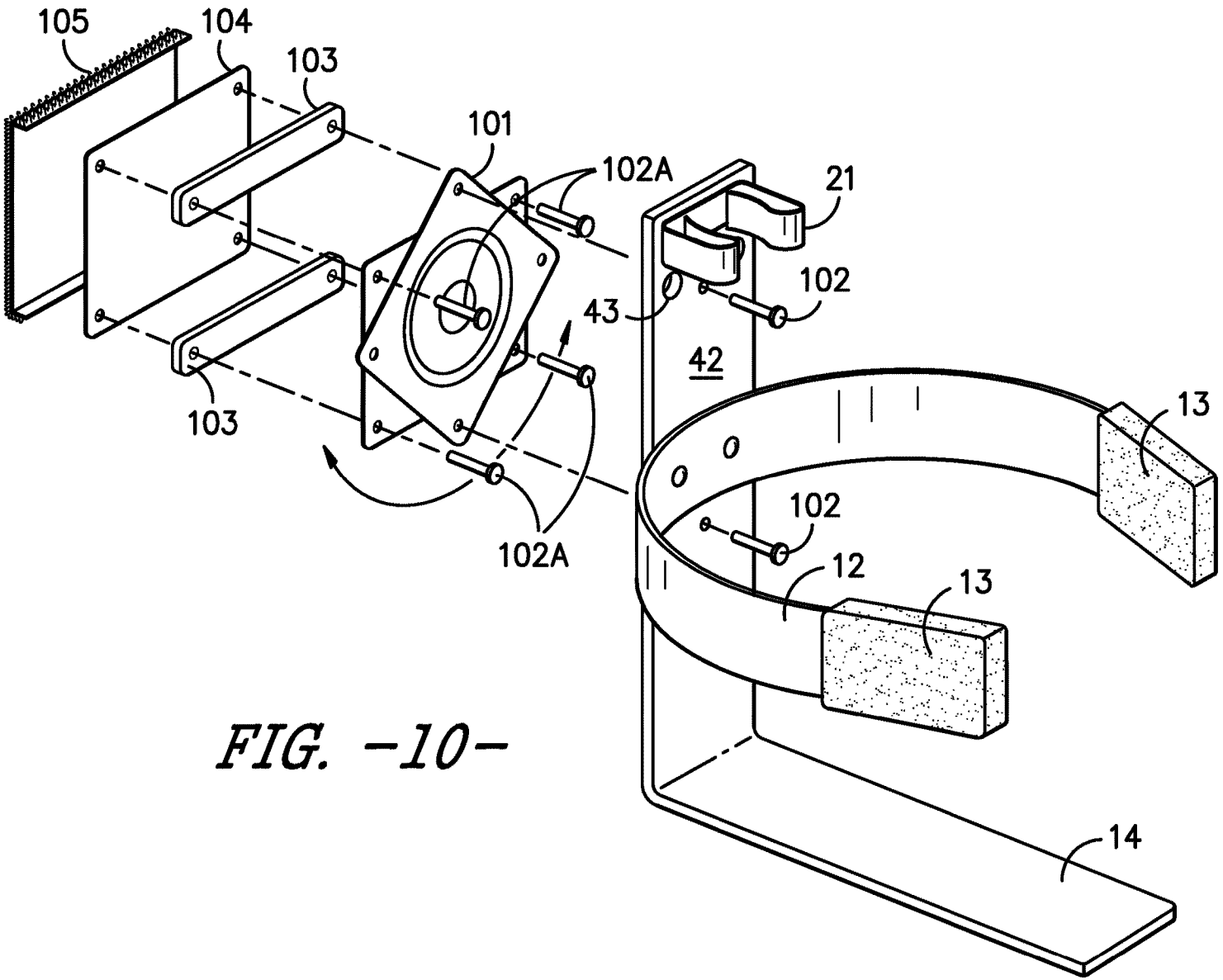
FIG. 10 is an exploded view of one embodiment of the subject invention including a swivel and belt loop for attachment to the user.
Figure 11:
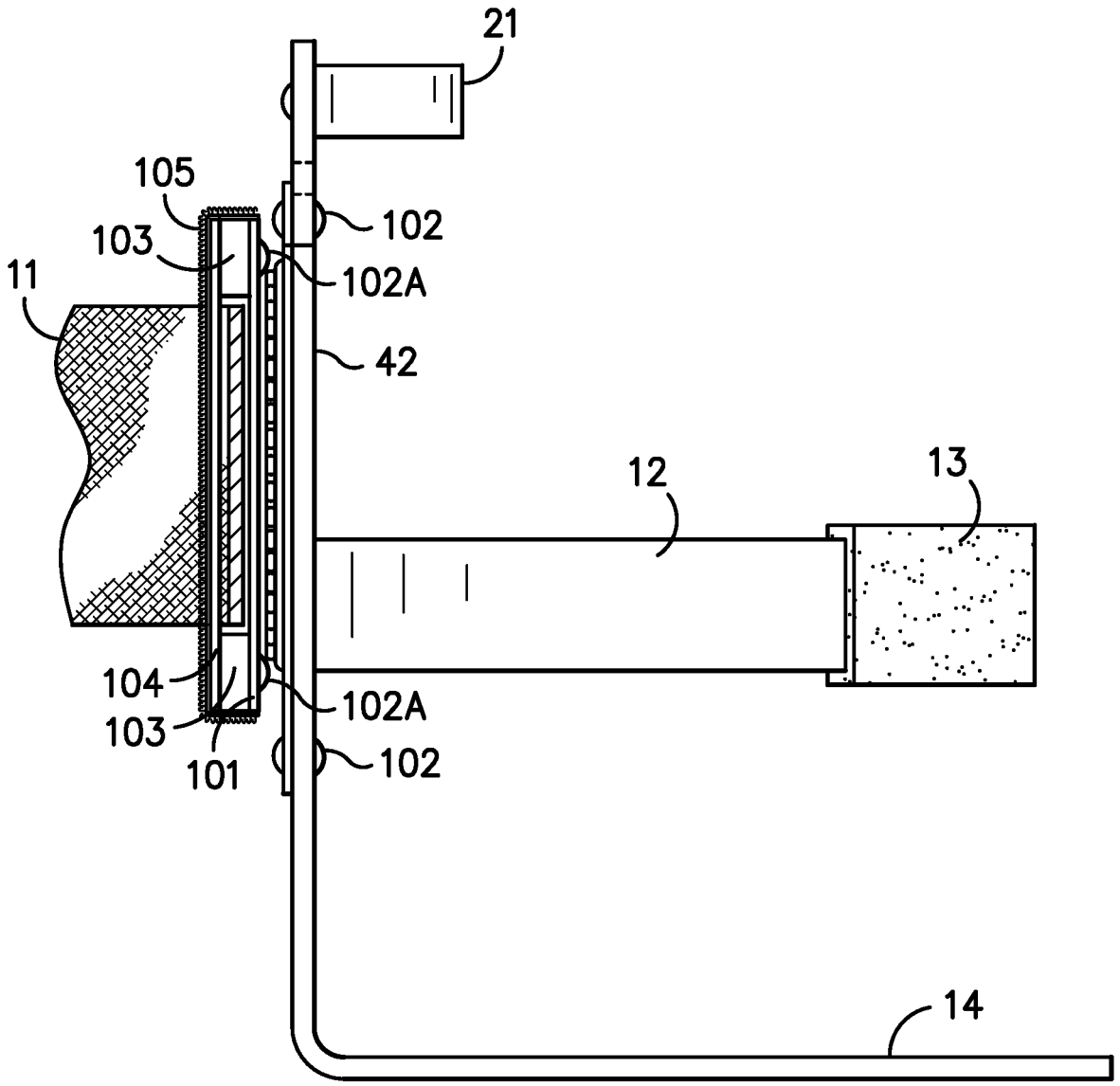
FIG. 11 is an orthogonal view of one embodiment of the subject invention with the assembled swivel and belt loop included.

The flat panel (42) is the center of the invention to which all other pieces are attached. The flat panel (42) features a an inner side, a an outer side, a top end that orients up when the flat panel (42) is in the vertical position, and a bottom end that orients down when the flat panel (42) is in the vertical position. An exploded diagram of one embodiment of the invention is shown in FIG. 10. Attached to the flat panel (42) on the outer side are two arms (12). Said arms (12) may be formed from a single piece of material that is U-shaped in nature with the nadir of the U attached to the flat panel (42). The two arms (12) extend roughly perpendicular from the flat panel (42) and end across from each other, open, with a width narrower than the diameter of the cylindrical object designed to be held, i.e. a standard paint can (15) in a preferred embodiment. The use of roughly to describe the perpendicular extension of the two arms (12) from the flat panel (42) is used to mean within a degree recognizable to a layman as perpendicular but not necessarily mathematically perpendicular. Elsewhere herein approximately or substantially may be substituted for roughly, and each time the term is used to imply that exactness is not required but that a recognizably close approximation is acceptable. Each arm (12) is semi-circle in shape with the inside of the semi-circles facing each other. The ends of each arm (12) may be covered with a cap (13). Said cap (13) may be merely a coating applied directly to the arm (12) or may be a separate object that is slid onto or otherwise affixed to the arm (12). In lieu of a cap (13) the arms may be bent upon themselves to eliminate sharp edges. The arms (12) should be made from a flexible, springy material that can be forced apart but yet snaps back into shape. Said material could be a plastic, metal, or any other medium with the appropriate qualities. The shape and springing quality of the arms (12) allow for the acceptance of a cylindrically shaped object within the arms (12), and such object includes, but is not limited to, paint cans (15).

The arms (12) are affixed to the flat panel (42) at a height above the base plate (14) that allows for a secure grip upon a standard one-gallon paint can (15) at or near the center of gravity for said can (15) when full. The base plate (14) protrudes from the bottom of the flat panel (42) roughly perpendicular from the flat panel (42) and is oriented such that a flat surface of the base plate (14) faces up and is in the horizontal plane substantially parallel to the arms. In one embodiment, shown in FIG. 10, the flat panel (42) and base plate (14) are integrated and made from a single piece of material which is bent substantially 90 degrees at the point of intersection of the flat panel (42) and base plate (14). In other embodiments, the flat panel (42) and base plate (14) may be fastened together at the bottom of the flat panel (42).

The positioning of the arms (12) and the flat base plate (14), in combination with the spring-like qualities of the arms (12), allow the user (17) to insert a paint can (15) into the Paint Can Holster in the horizontal direction. That is, the paint can (15) is inserted into the Paint Can Holster by sliding the paint can (15) along the base plate (14) and towards the user (17). The arms (12) of the Paint Can Holster are forced open and around the paint can (15). The arms (12) then spring back into shape and the tension exerted by the arms (12) helps to secure the paint can (15) within the Paint Can Holster. The end caps (13) of the arms (12) provide additional gripping surface to secure the paint can (15) and prevent it from sliding out.

In a preferred embodiment, the inner side of the flat panel (42) features a swivel attachment device (101-105). This device consists of a swivel (101) attached directly to the flat panel (42) by two fasteners (102) such as screws, rivets, bolts or similar fasteners. The swivel (101) is positioned upon the flat panel (42) such that the center of gravity for a full standard one-gallon paint can (15) is below the center point of the swivel (101). The swivel (101) is then attached to a belt loop formed by two spacers (103) and a belt loop plate (104). The two spacers and the belt loop plate are attached to the swivel (101) by four additional fasteners (102-A). The spacers (103) are opposite each other and parallel along the edges of the swivel (101). The spacers (103) separate the belt loop plate (104) from the swivel (101) enough distance to allow a regular belt (11) to run between the swivel (101) and the belt loop plate (104.) The side of the belt loop plate (104) facing-the-user may feature a hook-and-loop or other fastener covering (105) to accept an optional pad (31), which may be wedge shape.

Figure 7:
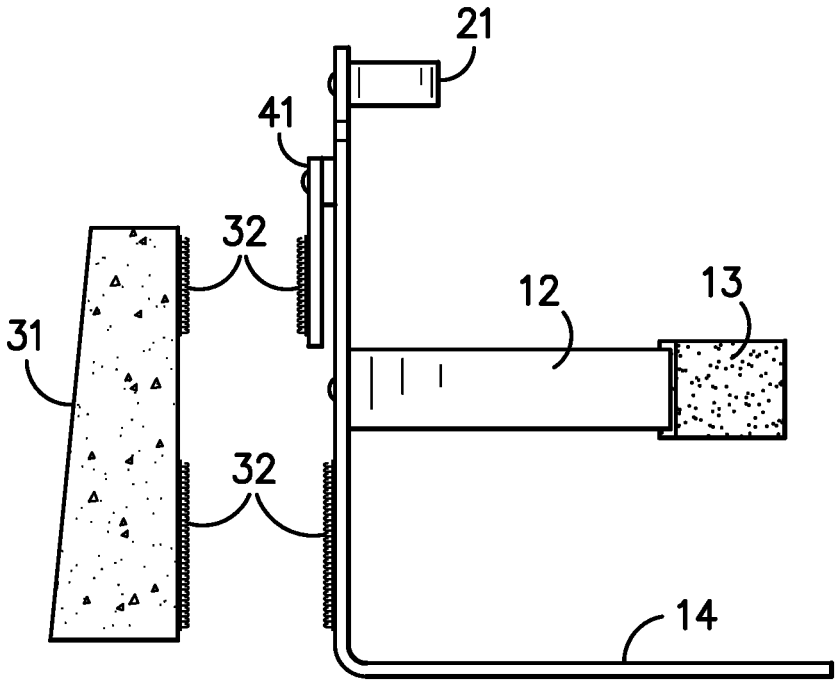
FIG. 7 is an orthogonal view of one embodiment of the subject invention shown with the optional wedge shaped pad disassembled.

In an embodiment without a swivel attachment device (101-105), a basic belt loop (41) may be substituted as the means of attaching the Paint Can Holster to the user. The belt loop (41) is attached to the flat panel (42) on the inner side. The belt loop (41) may feature an integrated spacer or a standalone spacer, such as the spacer (103) used in the swivel attachment device (101-105). In either formation, the belt loop (41) is offset from and parallel to the flat panel (42) to accommodate a regular belt (11). The belt loop (41) is shown in FIG. 7 without a bottom anchor to the flat panel (42) allowing the Paint Can Holster to be slid onto a belt (11) already worn by the user. This embodiment allows for the easy on and off of the Paint Can Holster.

The fit of the Paint Can Holster may be improved through the use of an optional pad (31). The pad (31) may be wedge shape with the narrow end facing towards the top end of the flat panel and the wide end facing towards the bottom end of the flat panel. Such shape of the pad (31) offsets the natural curve of the human waist and tilts the Paint Can Holster slightly into the user at the top end thereby helping to secure the paint can (15) within the holster. The pad (31) is attached to the Paint Can Holster through the use of hook-and-loop or other fastener coverings (32 and 105). The pad (31) may be used with either the swivel attachment device (101-105) or the belt loop (41). When used with the swivel attachment device, the hook-and-loop or other fastener (105) is attached to the side of the belt-loop-plate (104) facing the user. In the embodiment with a belt-loop (41), the hook-and-loop or other fastener (32) is attached to the flat panel (42) and belt-loop (41) on the side facing-the-user.

Figure 3:
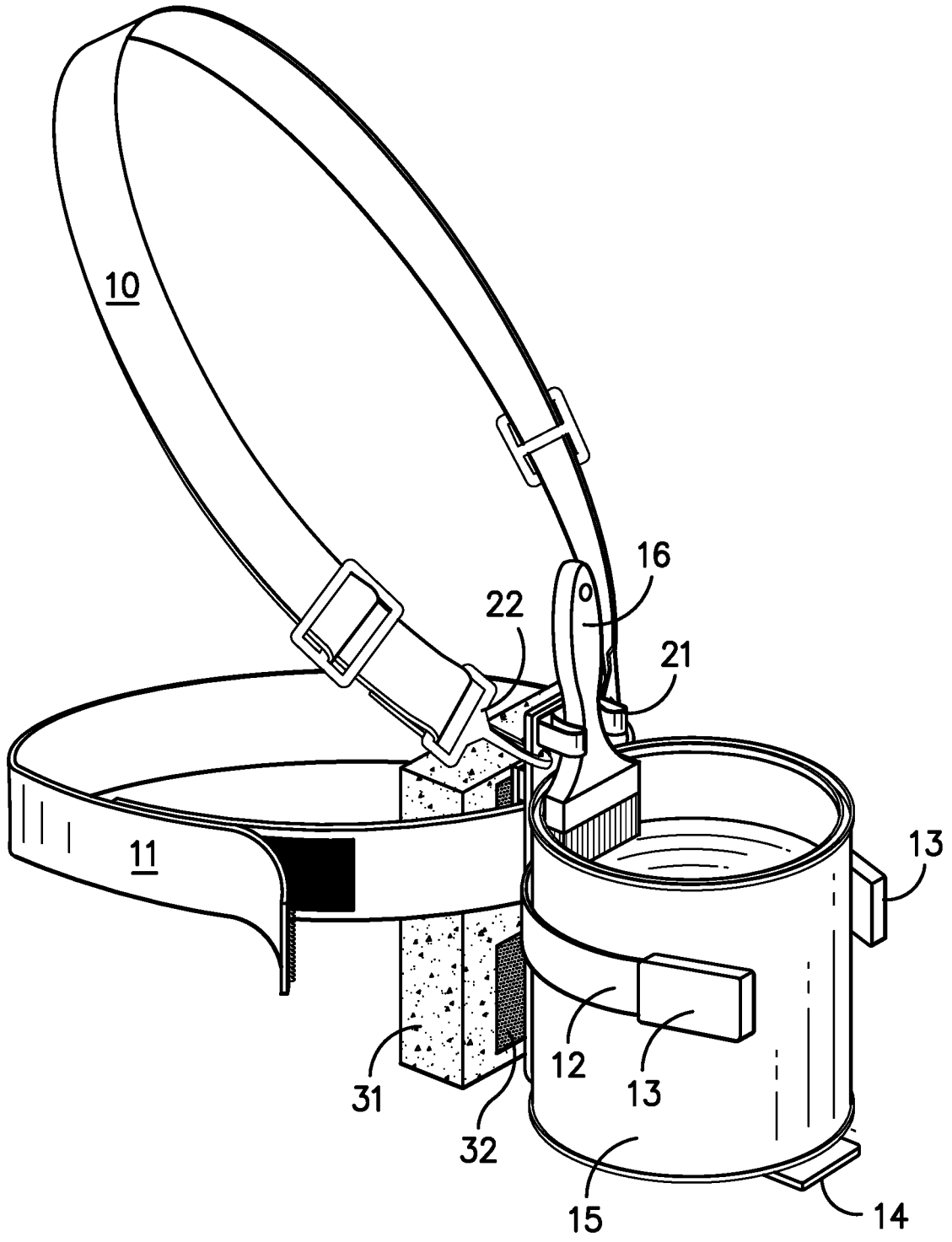
FIG. 3 is a perspective view of one embodiment of the subject invention, featuring a pad, showing the invention fully assembled and without the user.
Figure 4:
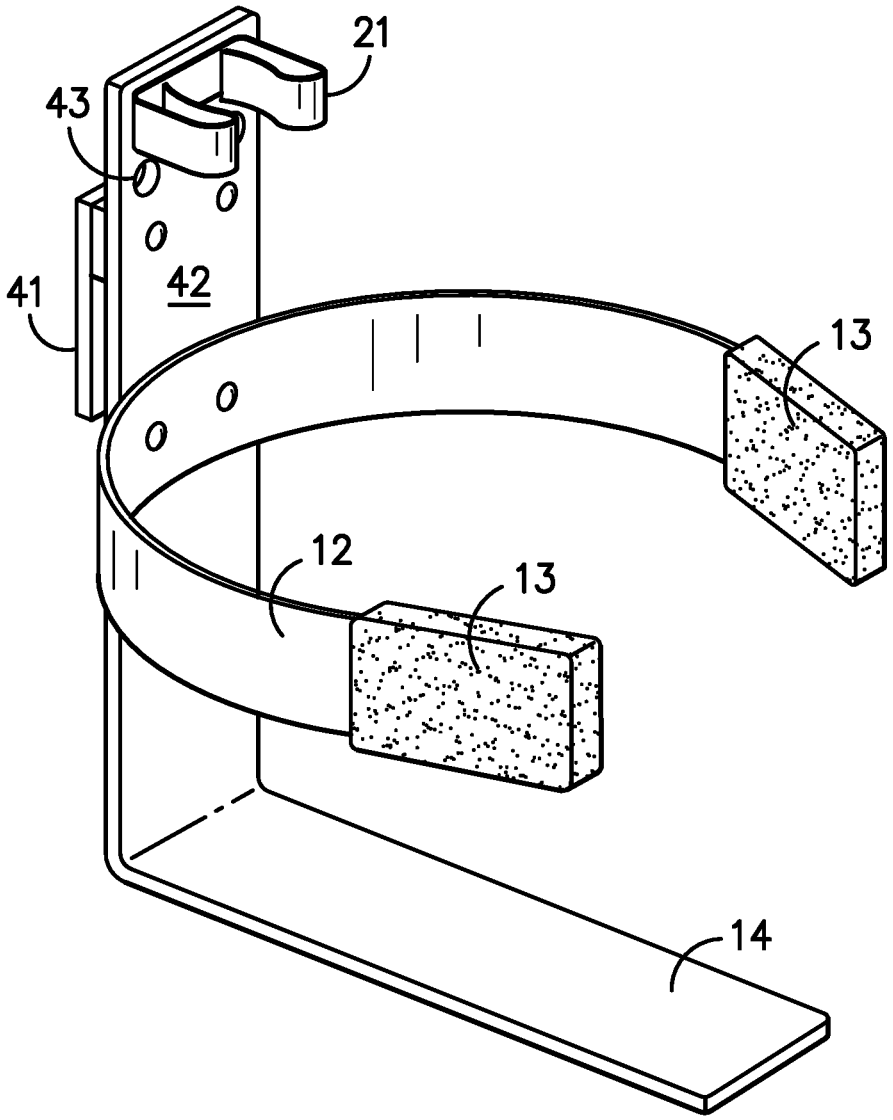
FIG. 4 is a perspective view of the assembled simplest embodiment of the invention including the paintbrush holder.
Figure 5:
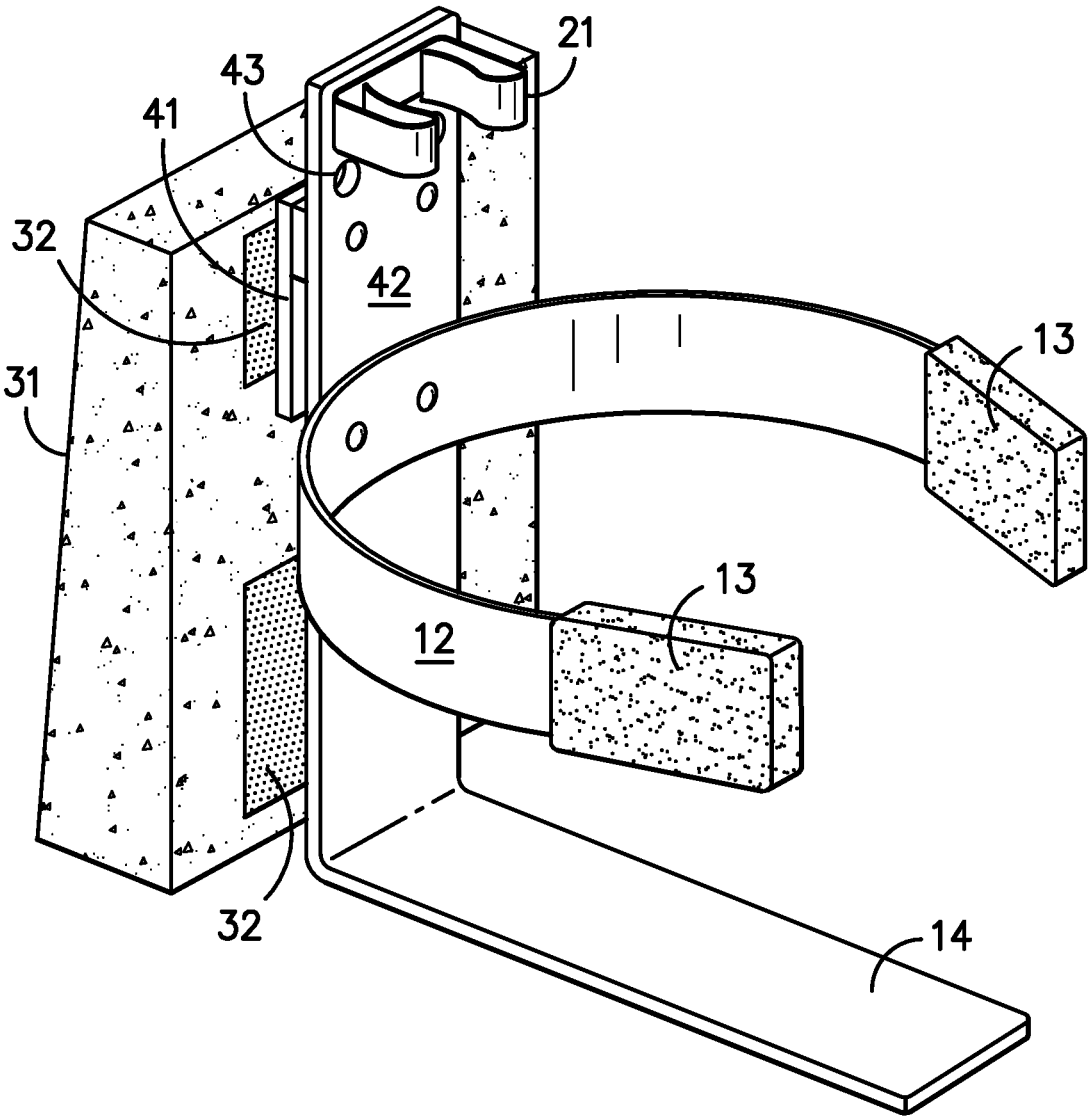
FIG. 5 is a perspective view of one embodiment of the assembled invention including a wedge shape pad and paintbrush holder.
Figure 6:
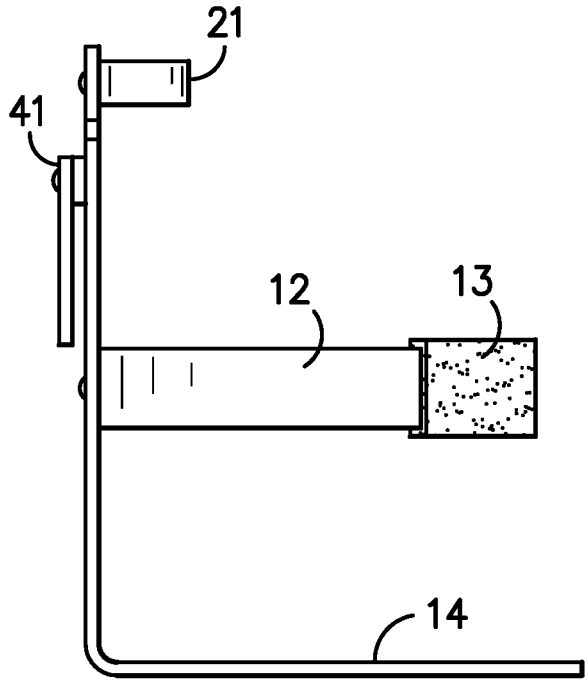
FIG. 6 is an orthogonal view of the simplest embodiment of the subject invention in assembled form.

In a preferred embodiment the Paint Can Holster includes a paintbrush holder (21) attached directly to the flat panel (42). The paintbrush holder (21) is attached to the outer side of the flat panel (42). The paintbrush holder (21) is positioned towards the top end of the flat panel (42) and above the lid of a holstered paint can (15). As shown in FIG. 3, the paint brush holder (21) is positioned such as to hold the paint brush (16) with the bristles of the brush contained within an open paint can (15). In this manner, the paintbrush (16) is both secured and contained preventing dripping paint within the work environment.

In a preferred embodiment, the flat panel (42) features one, or two attachment points (43) for the purpose of attaching a shoulder belt (10). The attachment points (43) may be as simple as a hole formed in the flat panel (42) sized to accept a fastener (22) such as an s-hook, carabiner clip, clasp, swivel clasp, spring snap, hook clasp, shackle, coupler, etc. The attachment points (43) should be near the top of the flat panel (42) but may be positioned slightly below the paintbrush holder (21) in an embodiment that minimizes the height of the flat panel (42). The shoulder belt (10) connects to the flat panel (42) at the attachment point (43), goes across the front of the user (17), over the opposite shoulder, around the back, and connects again to the flat panel (42) at the attachment point (43). The use of the shoulder belt (10) both removes weight from the user's waist and pulls the Paint Can Holster into the body of the user (17).

In a preferred embodiment, the shoulder strap is connected with a swivel clasp or other sliding connector and the belt loop is sized to allow the belt to slide easily through the loop permitting the user to freely slide the paint can holster from side to side or to the front of the user. In such configuration the user may readily reposition the paint can holster without removing the device and reattaching.

Figure 8:
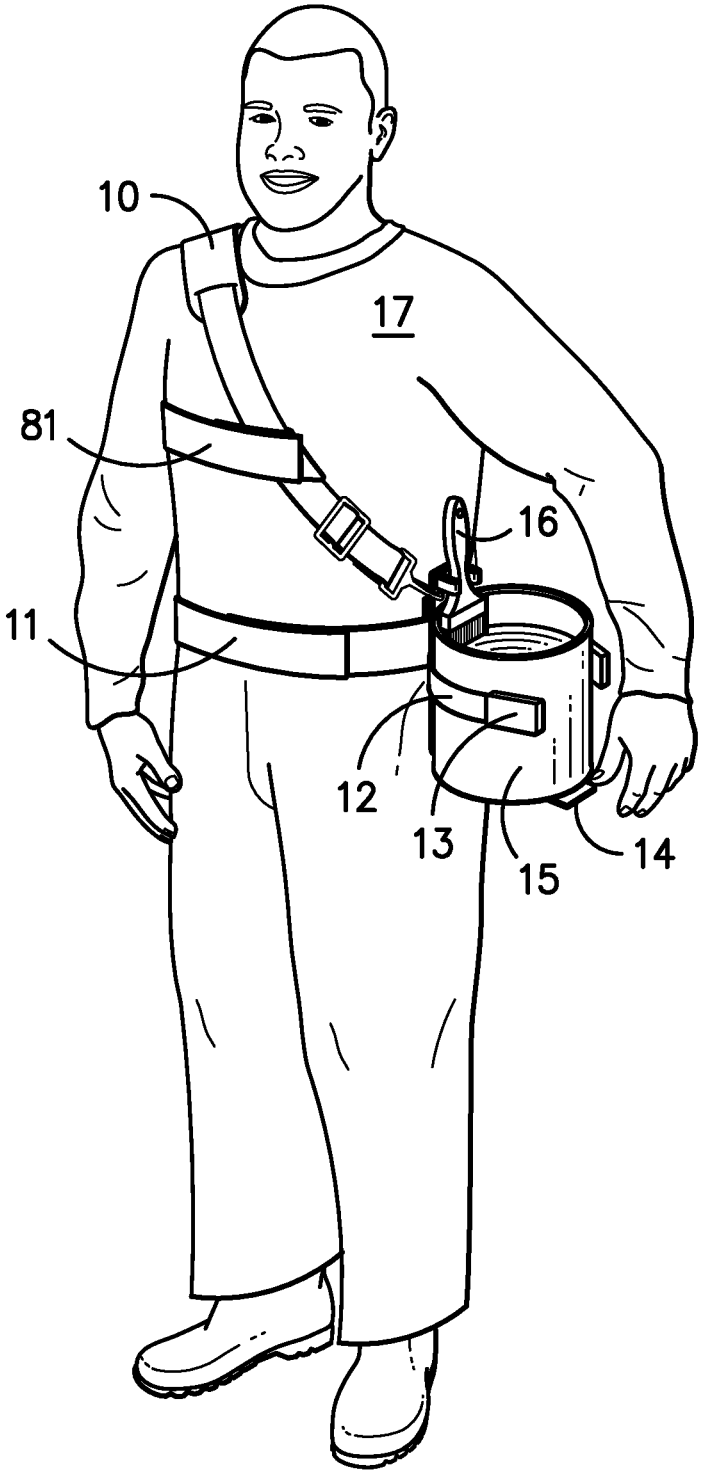
FIG. 8 is a perspective view of one embodiment of the subject invention, featuring the under arm strap, fully assembled and attached to the user in the standing position.
Figure 9:
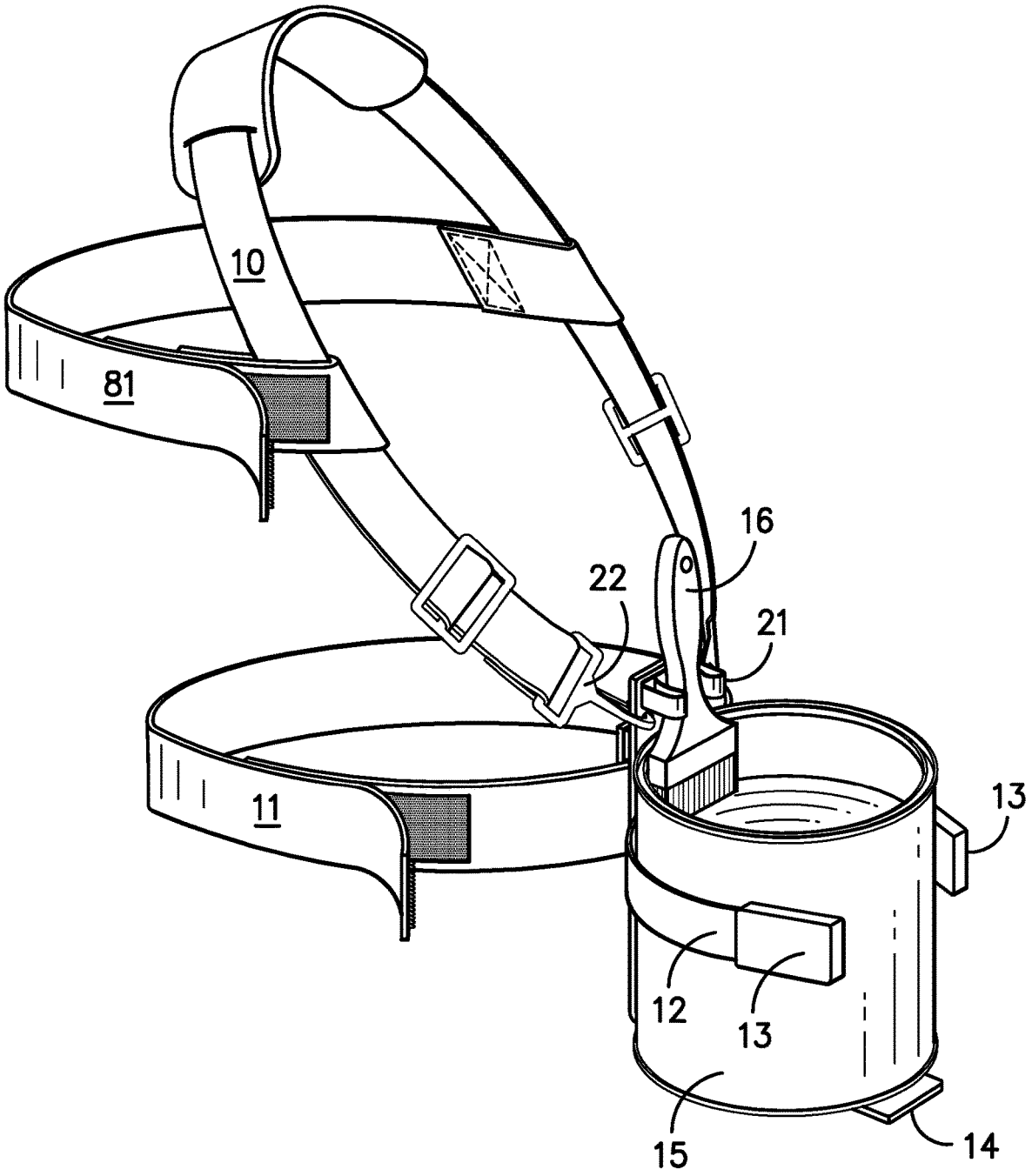
FIG. 9 is a perspective view of one embodiment of the subject invention showing the invention fully assembled and without the user.

The shoulder belt (10) may be augmented with an additional under arm strap (81) that attaches to the shoulder belt (10) in two locations. This configuration is shown in FIG. 9. The under arm strap (81) attaches to the shoulder belt (10) at chest height of the user (17) as shown in FIG. 8. The under arm strap (81) then runs across the chest of the user (17) under his arm, and around his back where it again attaches to the shoulder belt (10). The under arm strap (81) helps in securely holding the shoulder belt (10) in place and the Paint Can Holster against the user.

What is claimed is:

1. A belt attachment device comprising:

a. A flat panel with an inner side, an outer side, a top end when said flat panel is oriented in the vertical plane, and a bottom end when said flat panel is oriented in the vertical plane;

b. a belt loop attached to the flat panel on the inner side, said belt loop attached to the flat panel towards the top end of the flat panel;

c. two fasteners, the first attached to the flat panel on the inner side towards the bottom end and the second attached to the belt loop and facing substantially the same direction as the first fastener; and d. a pad secured to the flat panel and belt loop by the two fasteners.

2. A paint can holster for wear by a user comprising:

a. A flat panel with an inner side, an outer side, a top end when said flat panel is oriented in the vertical plane, and a bottom end when said flat panel is oriented in the vertical plane;

b. two arms attached to the flat panel on the outer side and extending outward substantially perpendicular from the flat panel to an end of each arm, said two arms each curved into a semi-circle, spaced in width an appropriate distance to accept a cylindrical shaped object, and made of springy material able to flex outward, away from each other, and naturally return to a position closer to each other;

c. a base plate, attached to the flat panel at the bottom end and extending outward from the outer side substantially perpendicular from the flat panel and substantially the length of the two arms, with a horizontal surface facing toward the two arms for providing support for the cylindrical shaped object;

d. a belt loop attached to the flat panel on the inner side, said belt loop attached to the flat panel towards the top end of the flat panel;

e. two fasteners, the first attached to the flat panel on the inner side towards the bottom end and the second attached to the belt loop and facing substantially the same direction as the first fastener; and f. a pad secured to the flat panel and belt loop by the two fasteners.

3. The paint can holster of claim 2 where the flat panel and the base plate are formed from a single piece of material.

4. The paint can holster of claim 2 further comprising a paintbrush holder attached to the flat panel on the outer side and towards the top end of the flat panel spaced on said flat panel such that a paintbrush is can be held with bristles of the brush within the cylindrical shaped object secured in the paint can holster.

5. The paint can holster of claim 2 further comprising a cap on the end of each arm.

6. The paint can holster of claim 2 where the fasteners securing the pad are hook and loop fastening.

7. The paint can holster of claim 2 further comprising one or more attachment point(s) on the top end of the flat panel suitable for accepting a S-hook, carabiner, coupling, shackle, clasp, or other attachment mechanism.

8. The paint can holster of claim 7 further comprising a shoulder belt attached to the flat panel at the attachment point(s) and comprising a front portion and a back portion.

9. The paint can holster of claim 8 further comprising an under arm strap attached to the shoulder belt, at both the front portion and the back portion, at chest height for a user.

10. The paint can holster of claim 2 further comprising a belt to encircle a user at the waist and to which the belt loop attaches.

11. A paint can holster comprising:

a. A L-shaped angle bracket with a long leg in the vertical plane and a short leg in the horizontal plane;

i. where the long leg of the L-shaped angle bracket has an inner side, an outer side, a top end with one or more attachment point(s) suitable for accepting a S-hook, carabiner, coupling, shackle, clasp, or other attachment mechanism, and a bottom end from which the short leg extends outward from the outer side;

ii. where the short leg in the horizontal plane has a surface facing upward towards the top end of the long leg and designed to support an object from below;

b. two arms attached to the long leg on the outer side and extending outward substantially perpendicular from the long leg and substantially parallel to the short leg to an end of each arm, said two arms each curved into a semi-circle, spaced in width an appropriate distance to accept a cylindrical shaped object, and made of springy material able to flex outward, away from each other, and naturally return to a position closer to each other;

c. two caps, one on the end of each arm, said two caps providing a gripping surface;

d. a flat plate attached to the long leg on the inner side and connected by a swivel to a second flat plate such that the plates turn independently;

e. two spacers, elongated in shape, sized to fit parallel to each other on the second flat plate leaving a gap large enough for a belt to fit smoothly between the two spacers, and attached to the second flat plate opposite the swivel;

f. a flat belt plate, substantially the same dimensions of the second flat plate, attached to the two spacers that are attached to the second flat plater;

g. a fastener attached to the flat belt plate;

h. a pad secured to the fastener;

i. a belt, lying between the flat belt plate and the second flat plate, able to slide freely through the slot created by the flat belt plate and the second flat plate, to encircle a user at the waist and attach the paint can holster to said user;

j. a shoulder belt attached to the long leg at the attachment point(s) and comprising a front portion, a back portion, and an under arm strap attached to the shoulder belt, at both the front portion and the back portion, at chest height for a user;

k. a paintbrush holder attached to the long leg on the outer side and towards the top end of the long leg spaced on said long leg such that a paintbrush can be held with the bristles of the brush within the cylindrical shaped object secured in the paint can holster.

12. The paint can holster of claim 11 where the fasteners securing the pad are hook and loop fastening.

* * * * *